US006116358A

United States Patent [19]

Fanuel

[11] Patent Number: 6,116,358

[45] Date of Patent: Sep. 12, 2000

[54] CORE SAMPLER

[75] Inventor: Philippe Fanuel, Brussels, Belgium

[73] Assignee: Baroid Technology, Inc., Houston, Tex.

[21] Appl. No.: 09/101,480

[22] PCT Filed: Jan. 15, 1997

[86] PCT No.: PCT/BE97/00006

§ 371 Date: Jul. 14, 1998

§ 102(e) Date: Jul. 14, 1998

[87] PCT Pub. No.: WO97/26440

PCT Pub. Date: Jul. 24, 1997

[30] Foreign Application Priority Data

Jan. 15, 1996 [BE] Belgium ..... 09600031

[51] Int. Cl.[7] ..... E21B 49/02

[52] U.S. Cl. ..... 175/250; 175/251; 175/253; 175/255

[58] Field of Search ..... 175/250, 251, 175/253, 255, 249; 294/86.26, 86.3, 86.31, 86.34

[56] References Cited

U.S. PATENT DOCUMENTS

| | | | |
|---|---|---|---|
| 1,373,492 | 4/1921 | Dodds | 175/255 |
| 2,090,304 | 8/1937 | Newsom | 175/250 |
| 2,503,561 | 4/1950 | Pickard . | |
| 2,713,473 | 7/1955 | Talbot . | |
| 2,915,284 | 12/1959 | Ortloff | 175/250 |
| 3,621,924 | 11/1971 | Lebourg | 175/58 |
| 4,930,587 | 6/1990 | Young et al. | 175/251 |

FOREIGN PATENT DOCUMENTS

| | | |
|---|---|---|
| 1008473 | 5/1996 | Belgium . |
| 0135926 | 4/1985 | European Pat. Off. . |
| 2088255 | 1/1992 | France . |
| 1634490 | 8/1970 | Germany . |
| 8200940 | 10/1983 | Netherlands . |

*Primary Examiner*—Hoang Dang
*Attorney, Agent, or Firm*—Browning Bushman

[57] ABSTRACT

A core sampler, particularly for use in oil prospecting, including a flexible movable ring (5), provided in particular at the front end (2) of the core sampler, which end is connected to a coring bit (3), for grasping a core sample (C) to be brought to the surface. The ring has a cylindrical internal surface (6) to be clamped around the core sample (C), and a frustoconical external surface (7) tapering towards the front end (2). In the end or starting position, the ring (5) is exposed to zero or minimal strain from the bearing surface (12) and has an internal diameter no smaller than the outer diameter of the core sample (C) to be grasped. The core sampler (1) comprises control mechanism for longitudinally moving the movable ring (5) from the end starting position to an end clamping position. A flexible sleeve (15) is advantageously substantially coaxial with the movable ring (5) and engages the side thereof opposite the front end (2) of the core sampler (1).

20 Claims, 6 Drawing Sheets

CORE SAMPLER

BACKGROUND OF THE INVENTION

1. Field of the Invention

The present invention relates to a core sampler, particularly for use in oil prospecting, comprising, particularly at its front end associated with a coring bit, for grasping a core sample to be brought to the surface:

- a deformable moving ring having a cylindrical internal surface designed to clamp the core sample, particularly when the latter is made of a so-called consolidated substance, and a frustoconical external surface which tapers toward the front end,
- a cavity which has a wall with an internal cone frustum-shaped bearing surface corresponding in terms of its shape and size to the external frustoconical surface of the moving ring, which is fixed to the core sampler at least in the longitudinal direction thereof and in which the moving ring can be housed in such a way that it can occupy, in the longitudinal direction, two extreme positions, one being a clamping position in which the moving ring pressed, on its small-diameter side, into the internal cone frustum is deformed inward so as to reduce its internal cross section and thereby clamp the core sample in order to immobilize it at this point in the core sampler.

2. Background of the Prior Art

A significant drawback of a core sampler of this kind, known at this time from patent application FR-A-2 088 255 (FIG. 1B) arises from the fact that the deformable moving ring is usually an elastic ring with a frustoconical external surface, split longitudinally and the inside diameter of which is smaller than the nominal inside diameter of the core sampler or than the outside diameter of a core sample made of consolidated substance, cut by the core sampler. The core sample which is formed has therefore to be pushed into the split ring in such a way as to open up this ring and keep it open. Blockage, known to the person skilled in the art, of the core sample in the split ring, and therefore in the core sampler, can therefore occur as a result of the constant friction between the core sample and the split ring and as a result, for example, of core-sample debris which may move therein because of this and become wedged between the core sample and the end of one of the slits if these slits are not made over the entire length of the ring. An expensive core-sampling operation may be completely compromised by this blockage. What is more, in the case of an unconsolidated core sample (sand, etc.), this smaller inside diameter of the deformable ring slows the progress of the core sample and upsets the original arrangement of its constituents, and this therefore considerably compromises the efficiency and results of the core-sampling.

Another significant drawback of the known core sampler arises from the complexity of producing a flattenable sheath as described in patent application FR-A-2 088 255, even an elastic one, because clearly, for a given circumference that allows a cylindrical core sample (FIG. 1B) to be housed, the sheath may have difficulty in adopting a flattened position where the largest transverse dimension is equal to twice the diameter of the aforementioned circumference. Furthermore, the flexibility imposed on the sheath means that the core sampler fluid system has to be kept under pressure while this sampler is being raised, and even for longer than this, until a complex handling operation, not explained, has been performed, if the core sample is not to be disturbed over a significant part of its length starting at the point where the sheath was flattened.

In addition, the aforementioned document neither shows nor suggests any interaction between the split ring and the flattenable sheath.

SUMMARY OF THE INVENTION

The object of the present invention is to overcome these drawbacks and to provide a core sampler whose operation is dependable, in the case of a core sample made of a consolidated substance, thanks to the fact that a large enough passage is provided for this sample and possibly, in the case of a core sample made of a substance that is undetermined at the start, thanks to the presence of means capable of effectively grasping core samples both made of consolidated and made of unconsolidated substances.

To this end, according to the invention, provision is made that

- in the other extreme position, known as the starting position, the moving ring is exposed to zero or minimal strain from the bearing surface and has an inside diameter not smaller than the outside diameter of the core sample to be grasped, and
- the core sampler comprises control means designed to move the moving ring in the longitudinal direction from the extreme starting position as far as the extreme clamping position.

According to a preferred embodiment of the invention which among other things makes it possible to avoid the other drawback mentioned hereinabove, the control means comprise

- a deformable sleeve,
  - arranged so that it is approximately coaxial with the moving ring, bearing against the opposite side thereof to the side at the front end of the core sampler,
  - having an inside diameter not smaller than the outside diameter of the core sample,
  - able to move in the aforementioned longitudinal direction, over a travel not shorter than that of the moving ring between its two extreme positions, and
  - comprising a deformable cylindrical wall situated immediately around the core sample to be grasped, and
- means which can be controlled in order to deform the deformable wall inward by applying a force to it, so as at least to clamp the core sample in order to fix thereto.

It is then particularly advantageous, at least as far as its deformable wall is concerned, for the sleeve to be made of a ductile metal which retains the deformation imposed on it.

Other details and particular features of the invention will emerge from the secondary claims and from the description of the drawings which are appended to this text and which, sometimes on different scales, illustrate, by way of nonlimiting examples, some embodiments of the core sampler of the invention.

DESCRIPTION OF THE ILLUSTRATED EMBODIMENTS

In the various figures, the same reference notation denotes elements that are identical or analogous.

Figure 1:
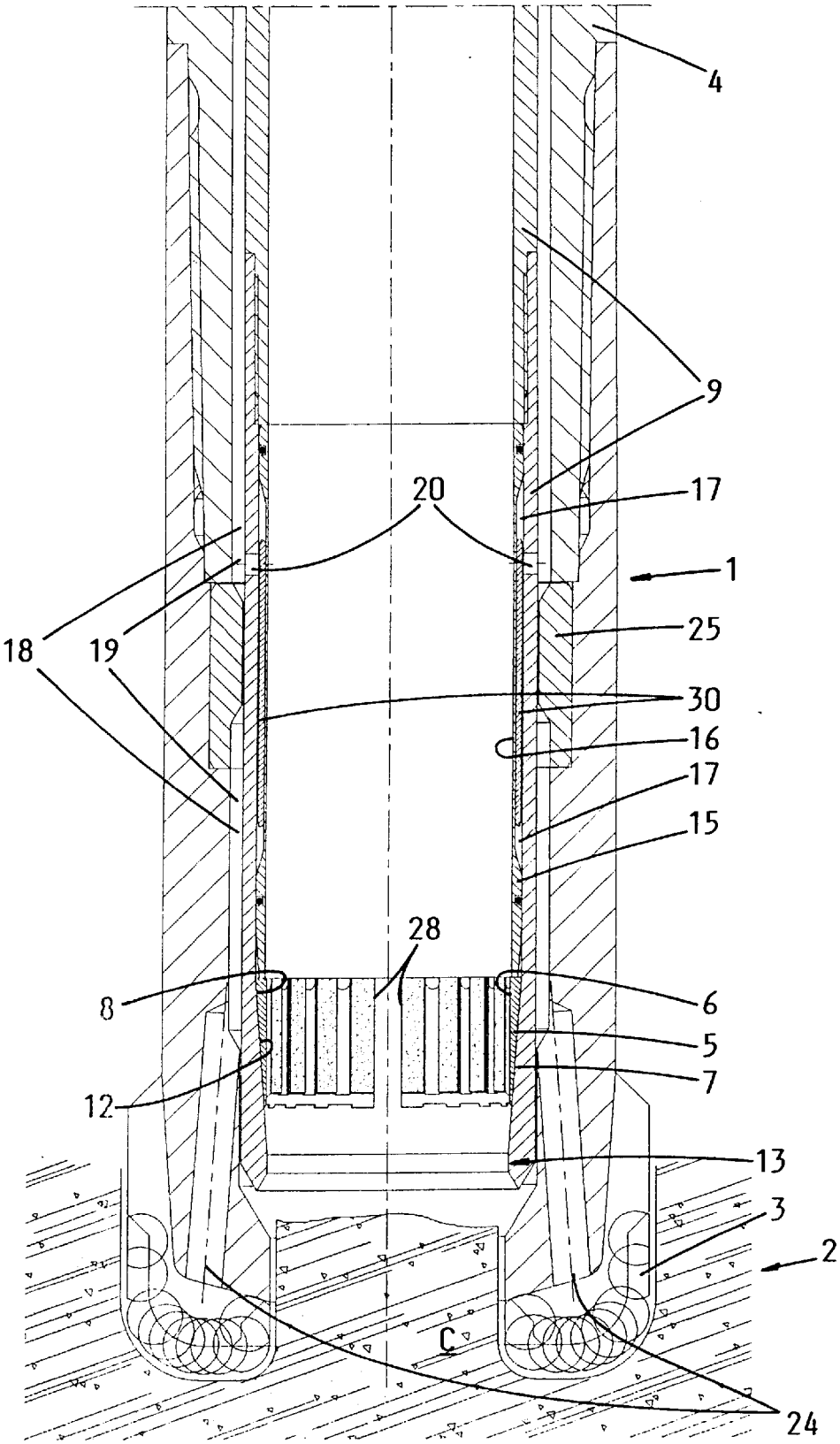
FIG. 1 depicts diagrammatically, with cutaway and in longitudinal section, a first embodiment of a core sampler of the invention.

With a view to grasping a core Sample (not depicted) to bring back to the surface, the core sampler 1 of the invention (FIG. 1) comprises, particularly at its front end 2 associated with a coring bit 3 carried by an outer barrel 4, a deformable moving ring 5 which has

- a cylindrical internal surface 6 designed to clamp the core sample C in a known way, particularly when this core sample is made of a so-called consolidated substance, and
- a frustoconical external surface 7 which tapers toward the front end 2.

The core sampler 1 also comprises a cavity 8 which, for example, forms part of a known inner barrel 9 via which it is fixed to the core sampler 1, at least in the longitudinal direction thereof. The cavity 8 has, for the moving ring 5, a wall with a bearing surface 12 in the shape of an internal cone frustum corresponding, in the known way, in terms of its shape and size to the aforementioned external frustoconical surface 7. The moving ring 5 can be housed in the cavity 8 in such a way that it can occupy two extreme positions therein, in the longitudinal direction. One extreme position is the clamping position in which the moving ring 5 pressed, following a movement in the longitudinal direction toward the small-diameter side 13, into the internal cone frustum 12 is deformed inward so as to reduce its internal cross section and in which it thereby clamps the core sample C in order to immobilize it at this point in the core sampler 1.

The term deformable may be understood as meaning that the moving ring 5 can, for example, be "crumpled" so as to reduce its internal cross section following radial pressure inward, exerted on its external frustoconical surface, or alternatively that it is, for example, slit through its entire thickness and over at least a significant part of its length (FIG. 2) or its entire length (FIG. 1) so that its internal cross section can be reduced under the same conditions of an aforementioned radial pressure.

In place of a cone frustum or of a frustoconical surface, it is possible also to use a pyramid frustum, or a cone frustum and a pyramid frustum may also be combined.

The so-called cylindrical internal surface and/or the so-called frustoconical external surface may be formed, for example, by folds of endless tape arranged in the manner of a so-called star-shaped filter canister as used, for example, in the automotive industry.

According to the invention, in the other extreme position, known as the starting position, the moving ring 5 is exposed to zero or minimum strain from the internal frustoconical wall 12 and therefore has an inside diameter not smaller than the outside diameter of the core sample C to be grasped.

Also according to the invention, the core sampler 1 comprises control means designed to move the moving ring 5 in the longitudinal direction from the extreme starting position as far as the extreme position of clamping the core sample.

In one embodiment (not depicted) of the core sampler 1, these control means may be an annular piston connected to the moving ring 5, placed between the inner barrel 9 and outer barrel 4 and actuated for example by a pressure of the core-sampling fluid which is greatly increased, in ways known by those skilled in the art, at the end of core-sampling just before the core sample starts to be raised.

According to an advantageous embodiment of the invention (FIGS. 1 and 2), the control means may comprise a deformable sleeve 15 which is arranged so that it is approximately coaxial with the moving ring 5, bearing against the opposite side thereof to the side facing the front end 2. The deformable sleeve 15 has an inside diameter not smaller than the outside diameter of the core sample C and it can move in the aforementioned longitudinal direction, over a travel not shorter than that of the moving ring 5 between its two extreme positions. The deformable sleeve 15 additionally comprises a deformable cylindrical wall 16 situated immediately around the core sample C to be grasped. The aforementioned control means further comprise means which can be controlled in order to deform the deformable wall 16 inward by applying a force, preferably at several points distributed around the core sample, so as at least to clamp this sample in order to fix solidly thereto if the core sample C is made of a consolidated substance.

As the core sample C may be made of an unconsolidated substance, at least at the point where the deformable sleeve 15 clamps it, the deformable wall 16 of this sleeve may then be made of a material chosen so that it can in practice be stretched toward the inside of the deformable sleeve 15, starting from a point or preferably several points situated practically in at least one and the same transverse plane, these points moving closer together and forming a restriction which impedes the passage of unconsolidated substance, then held captive in the inner barrel 9 of the core sampler 1. The thickness of the wall 16 is chosen as a function of the force to be applied and it may vary as a function of preferred points for deformation.

At least in the case of unconsolidated substances, it is preferable that, at least as far as its deformable wall 16 is concerned, the deformable sleeve 15 should be made of a ductile material which retains the deformation it has received, for example made of a metal or metallic alloy which in practice is inelastic.

The sleeve 15 of the invention may also be made of one or more materials then combined in various ways. Among other things, if it is desired that no passages or fissures should occur as a result of deformation, the sleeve 15 may be metallic and comprise, at least over part of its external peripheral surface, for example the surface most exposed to cracking, a jacket made of an elastic material (for example made of rubber vulcanized on to the sleeve 15) which remains appreciably impervious to a passage of fluid that deforms the sleeve 15.

The aforementioned sleeves 15 may have a rough internal surface so that they catch on the core sample more effectively.

The aforementioned control means may comprise an annular chamber 17 situated approximately coaxially around the deformable sleeve 15, the deformable wall 16 of which may form one wall of the chamber 17 on the same side as the core sample C. Another wall of the chamber 17, parallel to the aforementioned wall, may be the inner barrel 9 and the chamber 17 may be closed at its ends by thickened parts of the deformable wall 16 and by O-ring seals which provide a seal between these parts and the inner barrel 9.

The chamber 17 is intended to receive a control fluid. A conduit 18 is provided for supplying the control fluid to the annular chamber 17. Adjusting means known to those skilled in the art are provided for bringing the pressure of the control fluid to at least a pressure beyond which the deformable wall 16 deforms in order to at least bear against the core sample C.

Said control fluid may be the usual core-sampling fluid originating from a known installation on the surface. The conduit 18 may be formed, over at least part of its length, by an intermediate space or annular longitudinal duct 19 between two, for example coaxial, barrels of the core sampler 1, which barrels are arranged one inside the other like the inner barrel 9 in the outer barrel 4. The longitudinal duct 19 is then in fluid communication with the annular chamber 17 via one or more passages 20 through the inner barrel 9. At the front end 2, the longitudinal duct 23 may also be in fluid communication (FIG. 1 or 2) with known nozzles 24 arranged in the coring bit 3, via a ring 25, also known, for adjusting the pressure drop.

Figure 5:
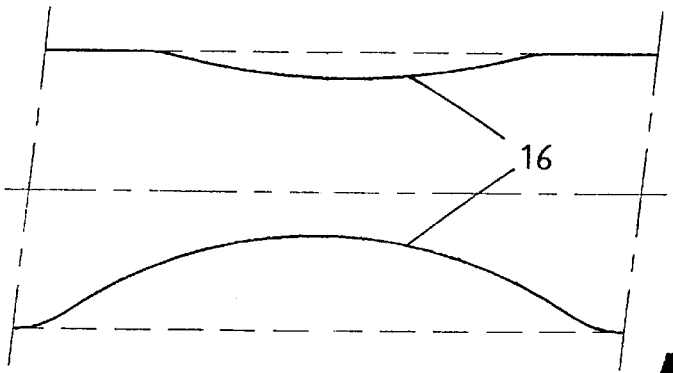
FIG. 5 shows diagrammatically in longitudinal section the same type of deformation of the deformable sleeve, the starting shape of which is depicted in broken line.
Figure 4:
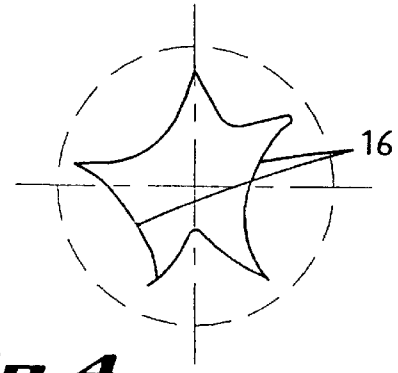
FIG. 4 shows diagrammatically in cross section a type of deformation, at its most deformed point, of a deformable sleeve, the starting section of which is depicted in broken line.
Figure 6:
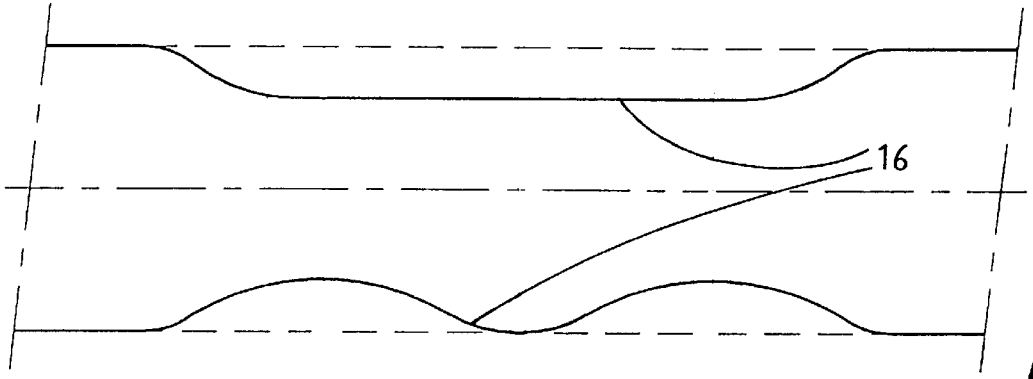
FIG. 6 shows diagrammatically in longitudinal section another type of deformation of the deformable sleeve, the starting shape of which is depicted in broken line.

FIGS. 4 to 6 show, for a fragile core-sample substance, types of deformation of the deformable wall 16 that can be influenced by making lines of weakness beforehand at points and in orientations that the person skilled in the art will determine experimentally, in order to obtain, for example, a tight restriction of the passage cross section in the deformed sleeve 15.

Figure 7:
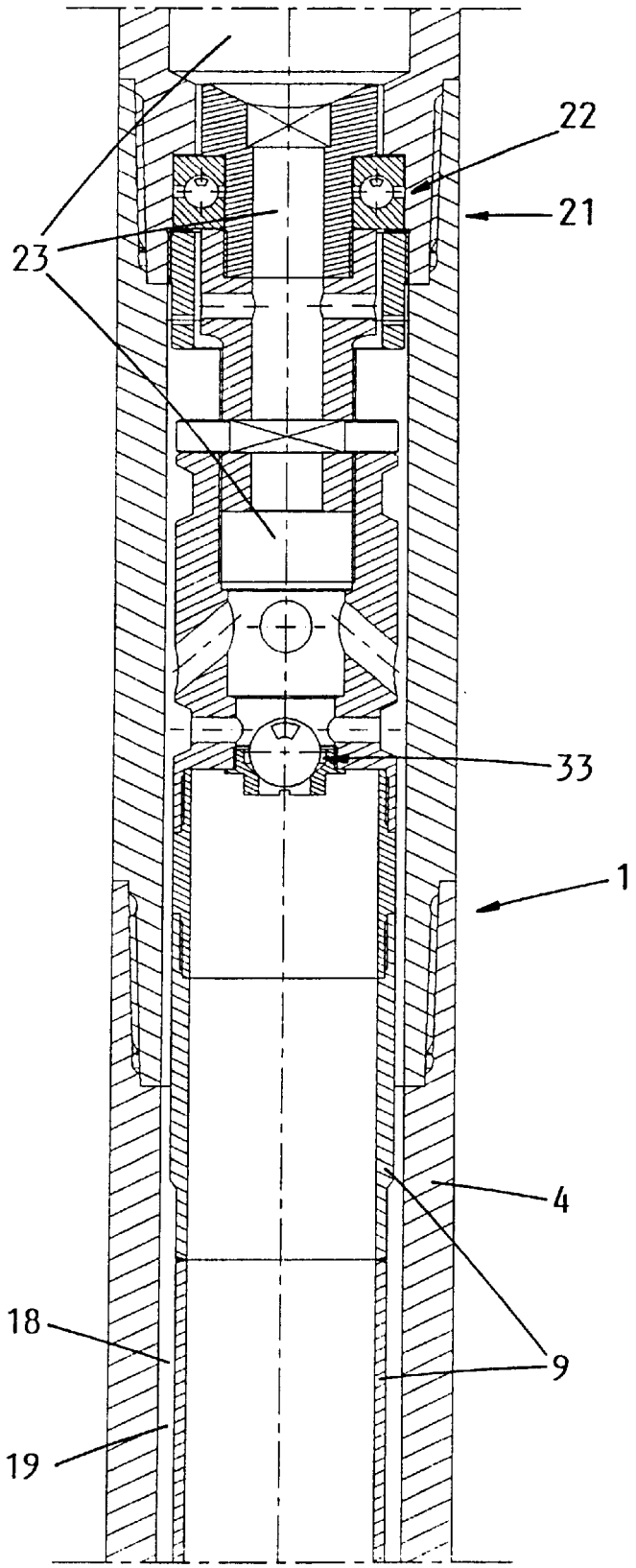
FIG. 7 depicts diagrammatically, in longitudinal section, with cutaway, the core sampler of FIG. 1 or 2 at the point of connection of the inner and outer barrels it comprises.

FIG. 7 shows by way of example, at the point 21 of connection of the inner barrel 9 and of the outer barrel 4 by a thrust ball bearing 22, a conduit 23 for supplying core-sampling fluid originating from an installation at the surface. The supply conduit 23 is in fluid communication with the annular longitudinal duct 19 between the outer barrel 4 and inner barrel 9.

When, following a core-sampling operation, there is a desire to raise the core sample C, the first operation is that of increasing, for example, the flow rate of core-sampling fluid which comes from the supply conduit 23 and escapes via the nozzles 24. The pressure of the core-sampling fluid increases in the longitudinal duct 19 as a result of the pressure drop brought about by the adjusting ring 25 situated downstream of the passages 20 in the direction of flow of the fluid. Beyond a pressure threshold which depends among other things on the material and on the thickness of the deformable wall 16, the pressure in the annular chamber 17 causes one or more deformations of the deformable wall 16 which therefore clamps the core sample C and may fix solidly thereto if the core sample is made of a consolidated substance. At this instant, the core sampler 1 can be raised and the core sample C, either because it is still fixed to the bottom or on account of its weight, even though it is detached from the bottom, forces the deformable sleeve 15 to bear against the deformable ring 5 and drive the latter into the cavity 8 with frustoconical walls 12. Because the surfaces are frustoconical, this driving movement causes the deformable ring 5 to be clamped on the periphery of the core sample C and the latter thereby to be immobilized at the base of the core sampler 1 for raising it.

If the substance of the core sample is not consolidated at the point of the deformable wall 16, this wall may be deformed, by the pressure applied, to the extent that it restricts the passage in the inner barrel 9 at this point enough to prevent the substance of the core sample from escaping. Thus, during raising, the weight of the core sample pressing on the deformable sleeve 15 will, in this case also, force the deformable ring into the cavity 8. At this instant, either the deformable ring 5 tightens on to a consolidated or resistant-enough part of the core sample C and this part acts like a stopper, or the substance of the core sample at the point of the deformable ring 5 is not resistant and escapes gradually as the ring 5 tightens, until the ring 5 reaches the stop. For this, for example, the ring 5 may be split longitudinally (FIG. 1) and the lips 28 of the slit press together and this prevents the ring 5 from being driven in any further. In this case, the aforementioned restriction is enough to close the inner barrel 9 at the front end 2.

Two semi-cylindrical shells 30 may be arranged in the annular chamber 17 in order to prevent deformation of the deformable wall 16 toward the inside of this chamber 17 under the action, for example, of debris from the core sample C passing between this sample and the deformable wall 16.

The deformable ring 5 may bear on the core sample via generatrices of its internal surface 6. This surface may be lined with a catching material or be knurled, or may have a catching net, etc.

Figure 2:
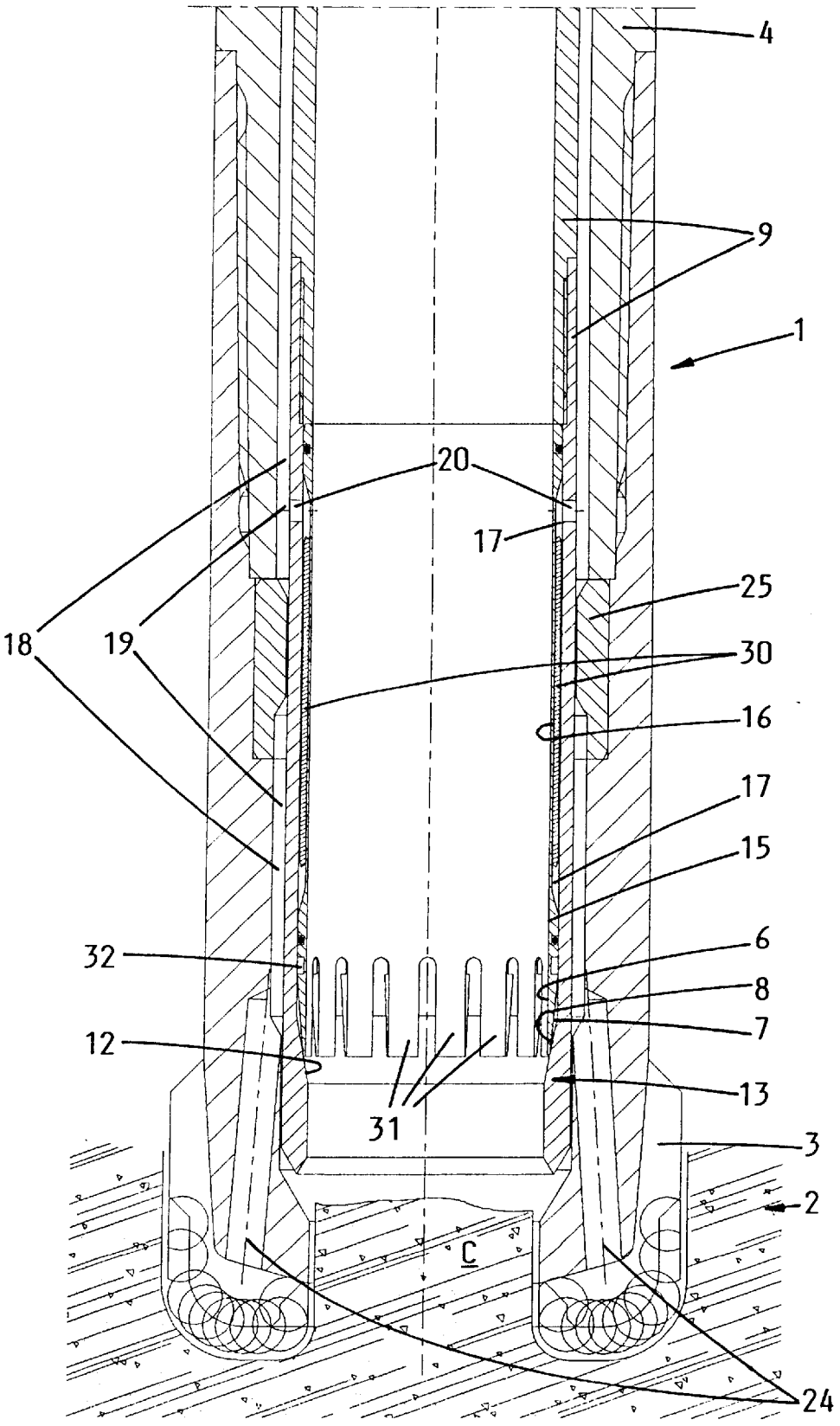
FIG. 2 depicts diagrammatically, with cutaway and in longitudinal section, a second embodiment of a core sampler of the invention.
Figure 3:
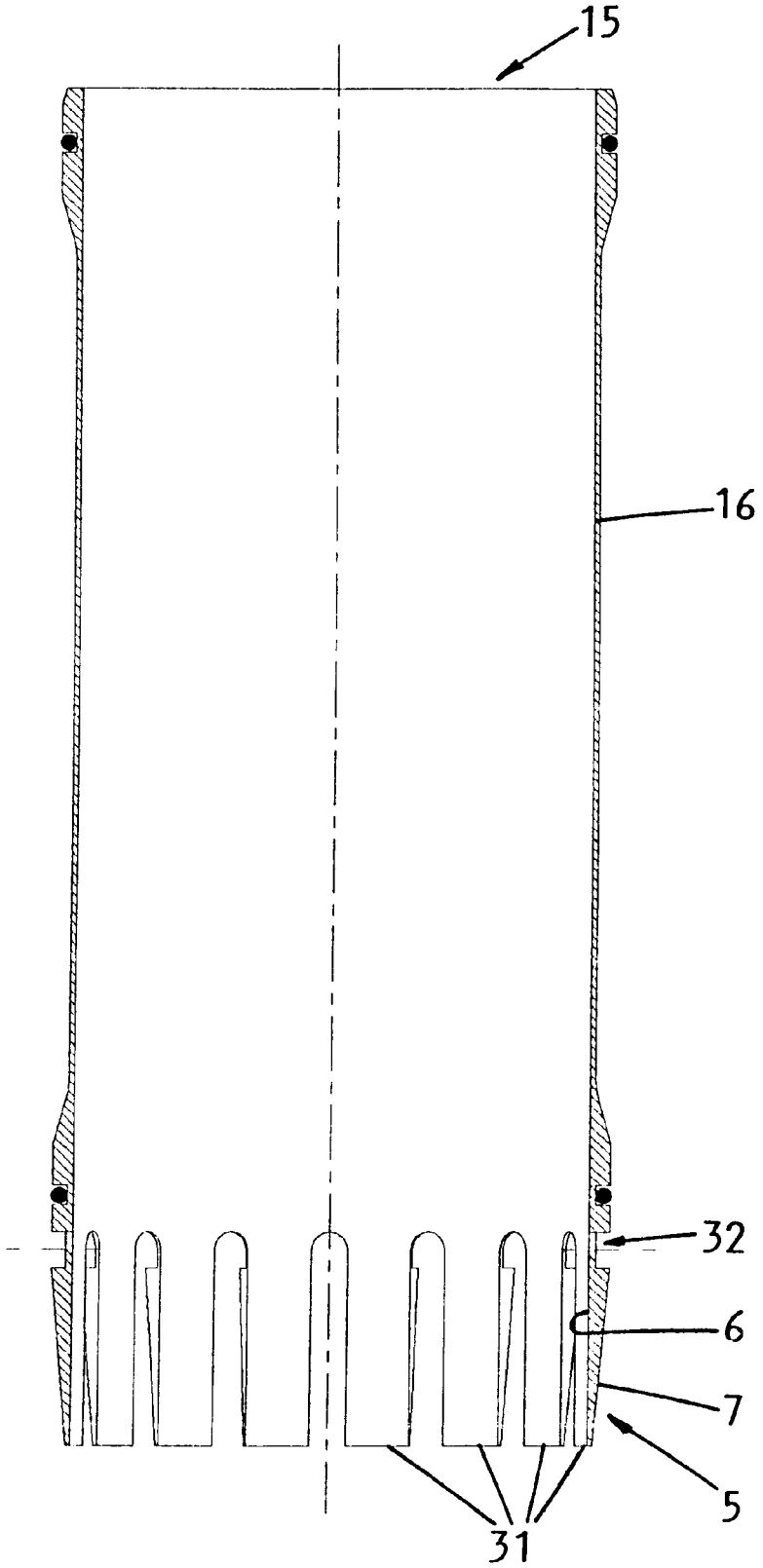
FIG. 3 depicts in longitudinal section a deformable sleeve used in the case of the second embodiment of the invention.

As FIGS. 2 and 3 show, the deformable moving ring 5 and the deformable sleeve 15 may be merely one component, because they are either fixed together or made this way. In the latter instance, the part that constitutes the deformable ring 5 may be formed of several tabs 31 of wedge-shaped longitudinal section and have slits between them so that they can tighten around a core sample C. The tabs 31 may, for example, have point contacts or contact along generatrices with the core sample and/or with the internal cone frustum 12. They may also be covered or machined as explained hereinabove in the case of the internal surface 6. A circular groove 32 may be provided at the point of connection of the tabs 31 and of the deformable sleeve 15, so as to make it easier for the tabs 31 to flex as they are driven into the cavity 8, toward the small diameter thereof.

According to FIG. 7, the inner barrel 9 may comprise, among other things, at its opposite end to the front end 2, a known valve 33 allowing core-sampling fluid to leave the inner barrel 9 as the core sample C enters it.

Figure 8:
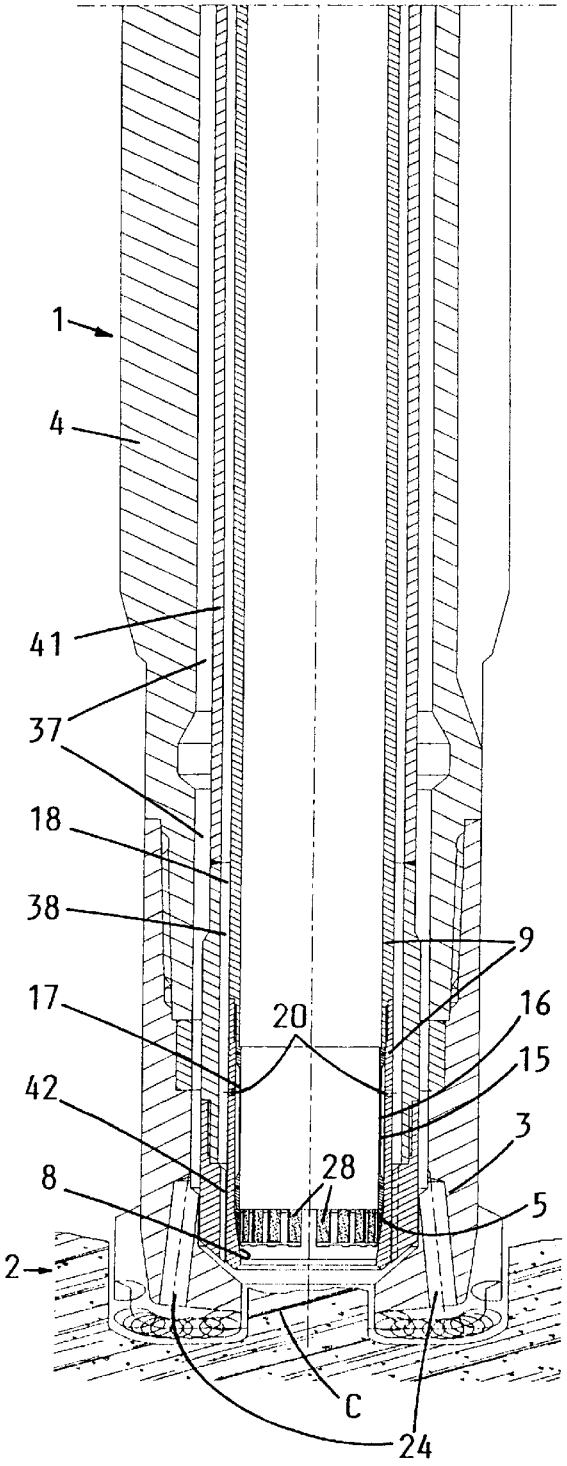
FIG. 8 depicts diagrammatically, with cutaway and in longitudinal section, a third embodiment of a core sampler of the invention.
Figure 9:
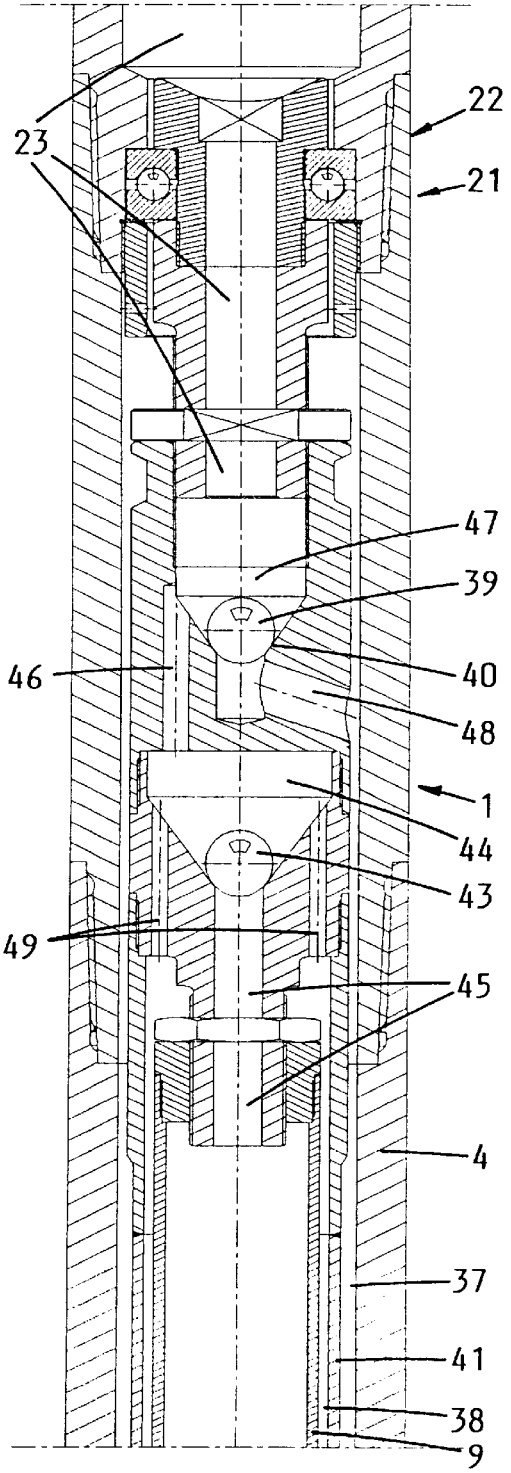
FIG. 9 depicts diagrammatically in longitudinal section, with cutaway, the core sampler of FIG. 4 at the point of connection of the coaxial barrels it comprises.

According to another embodiment of the invention (FIGS. 8 and 9), the aforementioned means of adjusting the pressure may comprise, in the conduit 18 designed to supply the core-sampling fluid to the front end 2, two lengths of ducting 37, 38 in parallel for the fluid. Each length of ducting 37, 38 may exhibit a given pressure drop for a given fluid flow rate. One of the lengths of ducting 37 is then arranged in such a way that it can be closed by a controlled valve 39, for example by a ball 39 thrown on to a valve seat 40 at the desired moment. The pressure drop in the other length of ducting 38 is chosen to then bring about, at the given fluid flow rate, an increase in pressure at least up to the pressure value which deforms the deformable wall 16 in the desired way.

The two lengths of ducting 37, 38 may advantageously be formed, at least in part, in the case of each of them, by an annular space lying between three approximately coaxial barrels of the core sampler 1. It is therefore preferable that a middle barrel 41 be arranged between the outer barrel 4 and the inner barrel 9. The annular space between the outer barrel 4 and the middle barrel 41 is the length of ducting 37, and the one between the middle barrel 41 and the inner barrel 9 is the length of ducting 38. The latter is in direct fluid communication with the passage or passages 20 and possibly with channels 42 for the passage of fluid between the middle barrel 41 and inner barrel 9 at the front end 2, while the ducting 37 is in direct fluid communication with the nozzles 24.

Another valve 43 (FIG. 9) in the form of a ball is arranged in a chamber 44 which is in direct fluid communication with the ducting 38 and with the supply conduit 23 and in fluid communication, controlled by the other valve 43, with the inside of the inner barrel 9.

During a core-sampling operation, provided the core sample enters the inner barrel 9, fluid can escape therefrom through a passage 45, through the other valve 43, through the chamber 44, through passages 49 to the ducting 38 and through the channels 42 toward the bottom of the core-sampling hole. Should this circuit become blocked, the fluid can still escape toward one or more passages 46, another chamber 47 (for the valve 39 at this moment absent), one or more passages 48 in order to reach the ducting 37 and therefore the nozzles 24.

Through the action of the other valve 43, fluid cannot travel from the supply conduit 23 into the inner barrel 9. At the same time, core-sampling fluid can travel from the supply conduit 23 to the nozzles 24 via the passage or passages 48 and the ducting 37.

At the end of core-sampling, before raising the core sampler 1, all that is required is for the ball 39 to be sent into the conduit 23. It is pushed into this conduit by the fluid until it comes to rest on its seat 40 and it then closes the entry to the passages 48 and therefore practically any flow rate of fluid through the nozzles 24. Given that the fluid from the supply conduit 23 can, from this moment on, pass only through the passages 46, the chamber 44 and the passages 49 toward the ducting 38 and therefore toward the passage channels 42, the fluid pressure increases and, via the passages 20, the fluid deforms the deformable wall 16. The subsequent operations of raising the core sample are as already described hereinabove.

It must be understood that the invention is not in any way restricted to the embodiments described and that many modifications may be made thereto without departing from the scope of the present invention.

Thus, all of the deformable moving ring 5, the aforementioned means of controlling it and the cavity may be arranged at other points along the core sampler 1 than at its front end 2.

In addition, the ducting 37, 38 may be produced in some way other than by the aforementioned corresponding annular spaces 37, 38.

List of Reference Numerals

C Core sample
1 Core sampler
2 Front end of core sampler 1
3 Coring bit
4 Outer barrel
5 Deformable moving ring
6 Ccylindrical internal surface of 5
7 Frustoconical external surface of 5
8 Cavity
9 Inner barrel
12 —Wall
Bearing surface
Internal cone frustum
Internal frustoconical wall
13 Small-diameter side of 12
15 Deformable sleeve
16 Deformable cylindrical wall
17 Annular chamber
18 Conduit
19 —Intermediate space
Annular longitudinal duct
20 Passages
21 Point of connection
22 Thrust ball bearing
23 Fluid supply conduit
24 Nozzles
25 Ring for adjusting pressure drop
28 Lips of split deformable ring 5
30 Semi-cylindrical shells
31 Tabs
32 Circular groove
33 Valve
37 —Ducting
Annular space
38 —Ducting
Annular space
39 —Controlled valve
Ball
40 Seat of valve 39
41 Middle barrel
42 Passage channels
43 Other valve (ball)
44 Valve chamber
45 Passage
46 Passage(s)
47 Other chamber, for valve 39
48 Passage(s)
49 Passages

What is claimed is:

1. Core sampler associated with a coring bit (3), for grasping a core sample (C) to be brought to the surface:

a deformable moving ring (5) having a cylindrical internal surface (6) designed to clamp the core sample (C) and a frustoconical external surface, a cavity (8) which has a wall (12) with an internal cone frustum-shaped bearing surface (12) corresponding in terms of its shape and size to the external frustoconical surface (7) of the moving ring (5), which is fixed to the core sampler (1) at least in the longitudinal direction thereof and in which the moving ring (5) can be housed in such a way that it can occupy, in the longitudinal direction, two extreme positions, one being a clamping position in which the moving ring (5) pressed into the internal cone frustum (12) is deformed inward so as to reduce its internal cross-section and thereby clamp the core sample (C) in order to immobilize it at this point in the core sampler(1), characterized in that in the other extreme position, known as the starting position, the moving ring (5) is exposed to zero or minimal strain from the bearing surface (12) and has an inside diameter not smaller than the outside diameter of the core sample (C) to be grasped, and the core sampler (1) comprises control means intended to move the moving ring (5) in the longitudinal direction from the extreme starting position as far as the extreme clamping position.

2. Core sampler according to claim 1, characterized in that the control means comprise a deformable sleeve (15), arranged so that it is approximately coaxial with the moving ring (5), having an inside diameter not smaller than the outside diameter of the core sample (C), able to move in the aforementioned longitudinal direction, over a travel not shorter than that of the moving ring (5) between its two extreme positions, comprising a deformable cylindrical wall (16) situated immediately around the core sample (C) to be grasped, and means which can be controlled in order to deform the deformable wall (16) inward by applying a force so as at least to clamp the core sample.

3. Core sampler according to claim 2, characterized in that the deformable wall (16) of this sleeve is made of a material chosen so that it can in practice be stretched toward the inside of the sleeve (15), starting from one or more points along this sleeve which are therefore situated approximately in at least one and the same transverse plane, these points moving closer together and forming a restriction which impedes the passage of core sample substance.

4. Core sampler according to any one of claims 1 to 3, characterized in that the moving ring (5) is fixed to a deformable sleeve (15).

5. Core sampler according to any one of claims 2 to 3, characterized in that the aforementioned control means comprise an annular chamber (17) which is situated approximately coaxially around the deformable sleeve (15), the deformable wall (16) of the sleeve forming one wall of the chamber (17) on the same side as the core sample (C), and which is intended to receive a control fluid, a conduit (18) designed to supply control fluid to the annular chamber (17), and adjusting means for bringing the pressure of the control fluid to at least a pressure value beyond which the deformable wall (16) deforms in order to bear against the core sample (C).

6. Core sampler according to claim 5, characterized in that the aforementioned control fluid is the core-sampling fluid.

7. Core sampler according to claim 5, characterized in that the conduit (18) is formed, over at least part of its length, by an intermediate space (19, 38) between two barrels (4, 9; 41, 9) of the core sampler (1), one barrel being arranged inside the other barrel.

8. Core sampler according to claim 5, characterized in that the adjusting means comprise, in the conduit (18) designed to supply the core-sampling fluid to a front end (2) of the core sampler, at least two parallel lengths of ducting (37, 38) for the fluid, each length of ducting (37, 38) exhibiting a given pressure drop for a given fluid flow rate, one of the two lengths of ducting (37) being arranged in such a way that it can be closed by a controlled valve (39), the pressure drop in the other length of ducting (38) being chosen to then bring about, at the given fluid flow rate, an increase in pressure.

9. Core sampler according to claim 8, characterized in that the two lengths of fluid ducting consist, at least in part, of two annular spaces (37, 38) lying between three coaxial barrels (4, 9, 41) of the core sampler (1), the outer barrel (4) and the inner barrel (9) and a middle barrel (41) placed between these three coaxial barrels, it be possible for the inner barrel (9) then to form for the annular chamber (17) a wall coaxial with the deformable wall (16) and at least one passage (20) being pierced in the inner barrel (9) in order to place the annular chamber (17) and the annular space (38) between the inner barrel (9) and middle barrel (41) in fluid communication, and in that the valve (39) is then situated in the length of ducting (37) formed by the annular space (37) between the outer barrel (4) and (41) in fluid communication with nozzles (24) of the coring bit (3).

10. Core sampler according to any one of claims 2 to 3, characterized in that said deformable wall (16) is made of a ductile metal which retains the deformation imposed on it.

11. A core sampler for grasping a core sample, comprising:

a coring bit associated with said core sampler;

a deformable moving ring having an internal surface designed to clamp said core sample;

a frustoconical external surface on said moving ring;

a wall defining a cavity having an internal cone frustum-shaped bearing surface corresponding in shape and size to said frustoconical external surface on said moving ring, said moving ring being housed in said cavity and being movable between a first extreme position and a second extreme position within said cavity, and wherein said second position comprises a clamping position in which said moving ring is pressed into said internal bearing surface and deformed inwardly to clamp said core sample and said first position comprises a starting position wherein said moving ring is exposed to minimal strain from said internal bearing surface and has an inside diameter not smaller than the outside diameter of said core sample; and a control mechanism for moving said ring from said first extreme position to said second extreme position.

12. A core sampler according to claim 11, characterized in that said control means comprises a deformable sleeve.

13. A core sampler according to a claim 12, characterized in that said deformable sleeve is deformable to form a restriction which impedes the passage of core sample substance.

14. A core sampler according to claim 12, characterized in that said moving ring is fixed to said deformable sleeve.

15. A core sampler according to claim 12, characterized in that said control means further comprises an annular chamber for receiving a control fluid, said annular chamber situated approximately coaxially around said deformable sleeve; and adjusting means for bringing the pressure of said control fluid to at least a pressure value beyond which said deformable sleeve deforms in order to bear against said core sample.

16. A core sampler according to claim 15, characterized in that said control fluid comprises a core sampling fluid employed in cutting said core sample.

17. A core sampler according to a claim 15, further comprising a conduit for conducting said fluid to said annular chamber.

18. A core sampler according to claim 15 wherein said adjusting means further comprises fluid flow rate responsive passages for raising the pressure in said annular chamber.

19. A core sampler according to claim 18 wherein said fluid communicates through said core sampler with nozzles of said coring bit.

20. A core sampler according to claim 12 wherein said sleeve is made of a ductile metal that retains the deformation imposed on it.

* * * * *